US009458684B2

(12) United States Patent
Armstrong et al.

(10) Patent No.: US 9,458,684 B2
(45) Date of Patent: Oct. 4, 2016

(54) PETROLEUM WELL INJECTION SYSTEM FOR AN INTERVENTION CABLE WITH A WELL TOOL RUN INTO OR OUT OF A WELL DURING A WELL OPERATION

(71) Applicant: C6 TECHNOLOGIES AS, Stavanger (NO)

(72) Inventors: Kenny Armstrong, Stavanger (NO); Tore Aarsland, Nærbø (NO)

(73) Assignee: C6 TECHNOLOGIES AS, Stavanger (NO)

( * ) Notice: Subject to any disclaimer, the term of this patent is extended or adjusted under 35 U.S.C. 154(b) by 0 days.

(21) Appl. No.: 14/771,442

(22) PCT Filed: Mar. 10, 2014

(86) PCT No.: PCT/NO2014/050031
§ 371 (c)(1),
(2) Date: Aug. 28, 2015

(87) PCT Pub. No.: WO2014/163508
PCT Pub. Date: Oct. 9, 2014

(65) Prior Publication Data

US 2016/0017675 A1 Jan. 21, 2016

Related U.S. Application Data

(60) Provisional application No. 61/776,278, filed on Mar. 11, 2013.

(30) Foreign Application Priority Data

Mar. 11, 2013 (NO) ..... 20130360

(51) Int. Cl.

| | |
|---|---|
| ***E21B 19/084*** | (2006.01) |
| ***E21B 19/22*** | (2006.01) |
| ***E21B 47/00*** | (2012.01) |
| ***E21B 19/24*** | (2006.01) |
| ***E21B 33/06*** | (2006.01) |
| ***E21B 41/00*** | (2006.01) |

(52) U.S. Cl.
CPC ..... *E21B 19/22* (2013.01); *E21B 19/084* (2013.01); *E21B 19/24* (2013.01); *E21B 33/06* (2013.01); *E21B 41/00* (2013.01); *E21B 47/0006* (2013.01)

(58) Field of Classification Search
CPC ..... E21B 19/06; E21B 19/084; E21B 19/20; E21B 33/06
See application file for complete search history.

(56) References Cited

U.S. PATENT DOCUMENTS

| | | | |
|---|---|---|---|
| 5,850,874 | A | 12/1998 | Burge et al. |
| 2002/0195255 | A1 | 12/2002 | Reilly |

(Continued)

FOREIGN PATENT DOCUMENTS

| | | | |
|---|---|---|---|
| GB | 2 457 585 | A | 8/2009 |
| WO | WO 98/14686 | A1 | 4/1998 |
| WO | WO 2011/096820 | A2 | 8/2011 |

OTHER PUBLICATIONS

International Preliminary Report on Patentability issued in PCT/NO2014/050031, dated Jun. 24, 2015.

*Primary Examiner* — William P Neuder
(74) *Attorney, Agent, or Firm* — Birch, Stewart, Kolasch & Birch, LLP

(57) ABSTRACT

A petroleum well injection system is provided for an intervention cable with a well tool ran into or out of a well during a well operation. The system includes a blow out valve BOP connected to a well head at a well, a lock chamber at the BOP arranged to contain the well tool before and after the well operation, an injector for the intervention cable, with drive belts driven by an electric motor, and a sensor for measuring the injector force or the tension that the drive belts applies to the intervention cable, a guide arch at the injector, wherein the intervention cable runs taut over the guide arch to a first end of the closed bending restrictor channels, a guide arch load cell arranged to measure the backward tension between an intervention cable the first end of the bending restrictor channel, and wherein the other end of the bending restrictor channel is connected to a drum frame with a motor running a drum for the intervention cable.

13 Claims, 3 Drawing Sheets

(56) References Cited

U.S. PATENT DOCUMENTS

Figure 1:
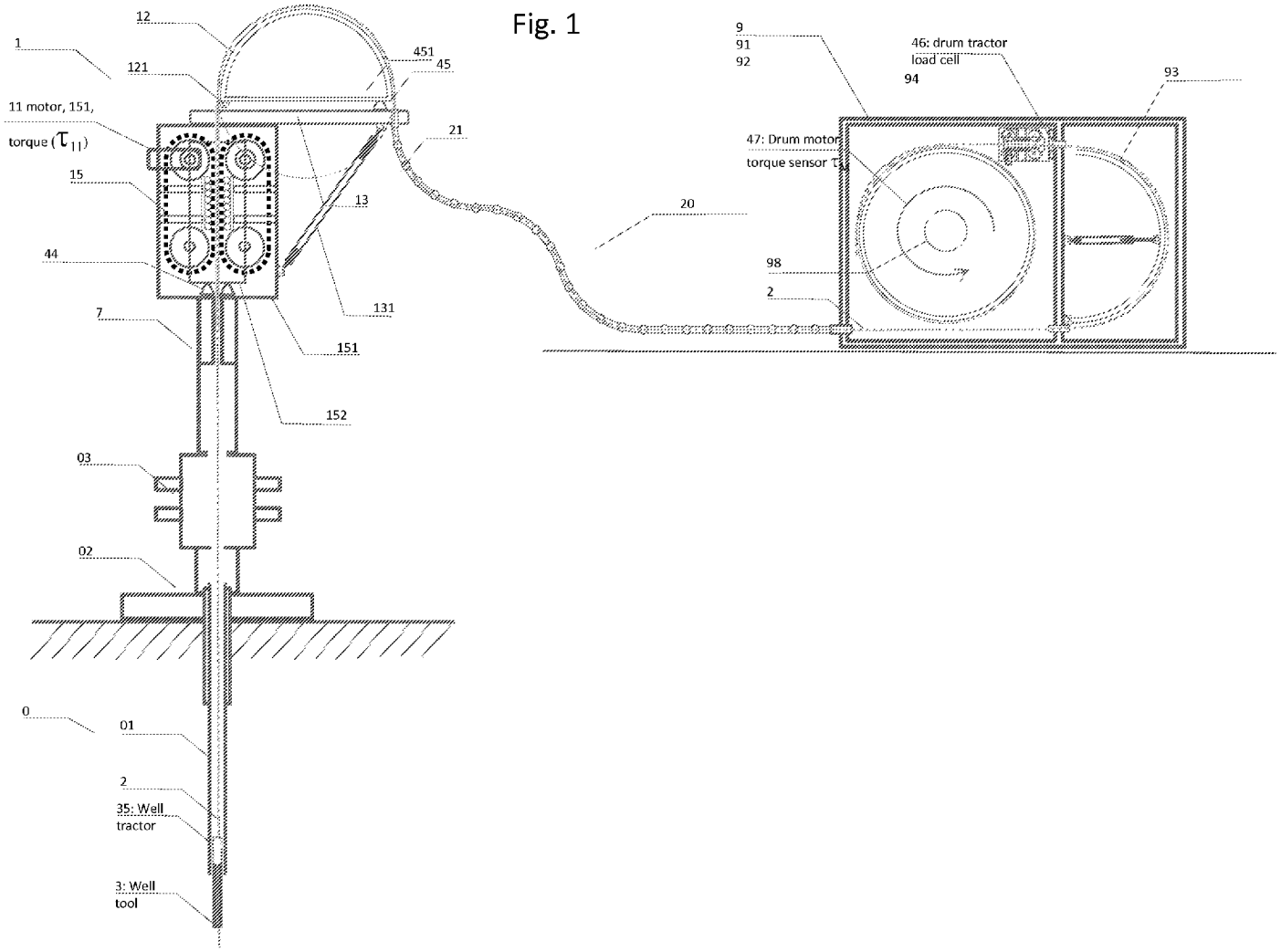

2006/0124314 A1* 6/2006 Haheim ..... E21B 19/22
166/368
2007/0246261 A1 10/2007 Lowe et al.
2010/0307760 A1* 12/2010 Shouse ..... E21B 33/076
166/339
2011/0168401 A1 7/2011 Hebert

* cited by examiner

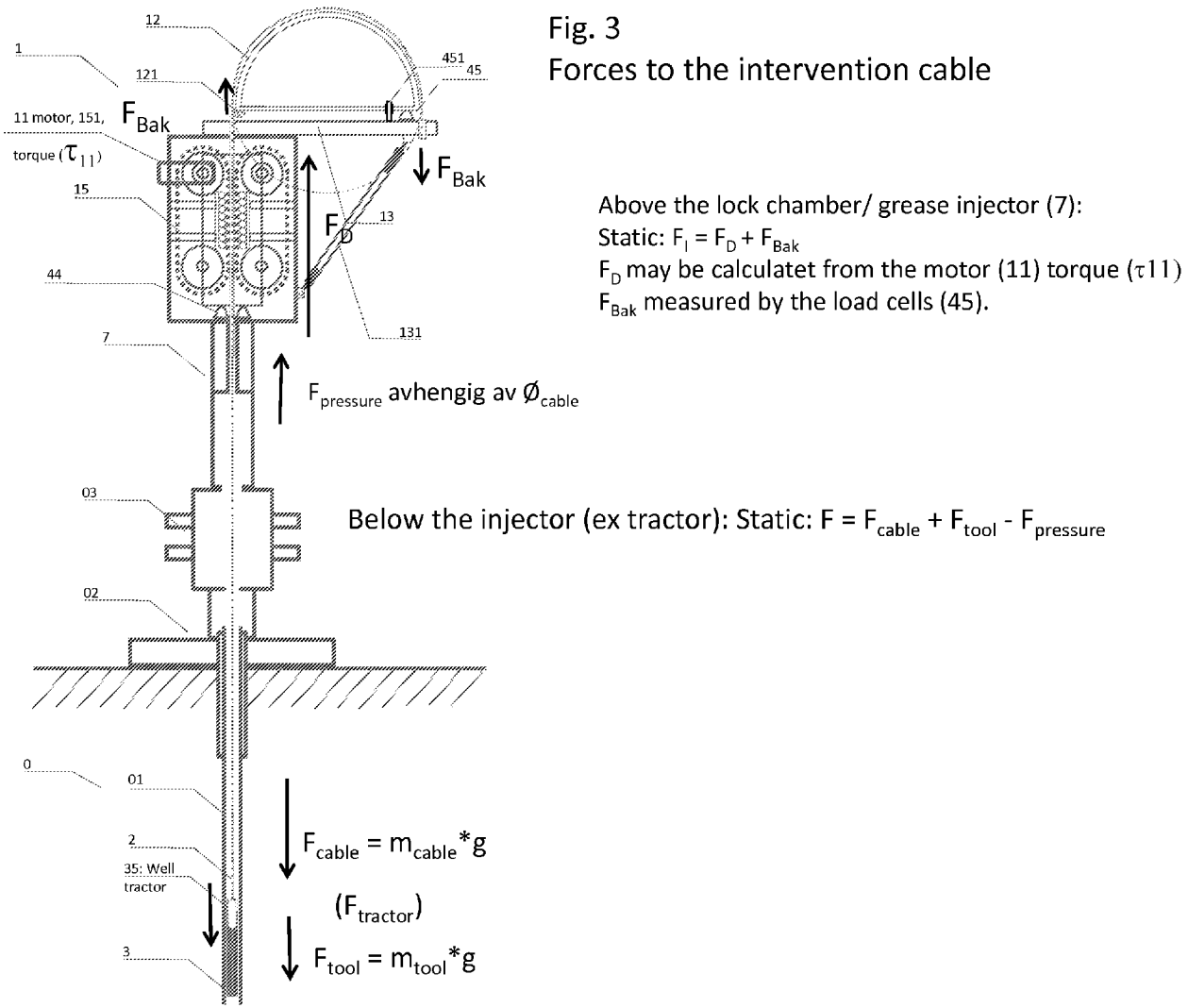
Fig. 3
Forces to the intervention cable
Above the lock chamber/ grease injector (7):
Static: $F_I = F_D + F_{Bak}$
$F_D$ may be calculatet from the motor (11) torque (τ11)
$F_{Bak}$ measured by the load cells (45).
$F_{pressure}$ avhengig av $Ø_{cable}$
Below the injector (ex tractor): Static: $F = F_{cable} + F_{tool} - F_{pressure}$
$F_{cable} = m_{cable} * g$
($F_{tractor}$)
$F_{tool} = m_{tool} * g$
$F_{Bak}$
$F_D$
11 motor, 151,
torque ($\tau_{11}$)
35: Well tractor
1
12
121
15
44
7
03
02
01
0
2
3
13
131
451
45

PETROLEUM WELL INJECTION SYSTEM FOR AN INTERVENTION CABLE WITH A WELL TOOL RUN INTO OR OUT OF A WELL DURING A WELL OPERATION

CROSS REFERENCE TO RELATED APPLICATIONS

This application is the National Phase of PCT International Application No. PCT/NO2014/050031, filed on Mar. 10, 2014, which claims priority under 35 U.S.C. 119(e) to U.S. Provisional Application No. 61/776,278, filed on Mar. 11, 2013 and under 35 U.S.C. 119(a) to Patent Application No. 20130360, filed in Norway on Mar. 11, 2013, all of which are hereby expressly incorporated by reference into the present application.

INTRODUCTION

Present invention relates to a system for injection of an intervention string to a well. More specific the system comprise a cable drum, an intervention string guide, with a bending restrictor onto a well injector with appurtenant load cells and a lock-chamber at a well head at a petroleum well.

CURRENT PROBLEMS

Prior art describes feeding out and hauling inn a free hanging cable run, between a cable drum and the well, with a possible injector mechanism at the well, for instance a tractor belt, or a tractor injector, generally driven by a hydraulic motor. Changes in speed between the injector and the drum compensates by changing the slack of the freely-hanging cable run. The freely-hanging cable run may involve danger to the personnel, and requires a large free space between the units. By the use of an intervention cable, of a relatively stiff composite cable or coiled tubing type, this will have a limited minimum allowable bending radius, and is more vulnerable to impacts and damages than a wire cable.

PRIOR ART

In a well intervention, or a well logging, an intervention tool, or a well tool is used, and is lowered into a petroleum well at a so called string, also called intervention string or intervention cable. The string to be used with the present invention may be of a rigid rod formed cable, generally a fibre composite cable such as an ab. 10 mm Ø carbon fibre rod with electric and/or optical conductors, or in a pipe with a certain bending stiffness, such as a coiled tubing, for the intervention string or the intervention cable to be rigid enough to be rodded into the well. The rodding process may be performed by a tractor mechanism. The string may in the prior art, more traditionally, be a thin plain wire line with, or without, electrical or optical conductors inside, or a twisted or braided regular wire with an electrical or optical conductor inside, i.e. strings that may not be rodded into the well.

Over-push is a longitudinal compression that is possible to a relative rigid rod formed intervention cable, but not to a thin plain wire line or a twisted wire or rope, and the rigid intervention cable buckles out to the side and is damaged or broken. A pipe may risk to be broken or substantially weakened. A carbon fibre rod may also buckle out and may delaminate and subsequently break or be substantially weakened. Over-pull may occur to all types of strings: coiled tubing, carbon fibre rod—cable, thin plain wire, wire cable and rope.

It is important to prevent and inhibit so called over-pull and so called over-push in all types of well intervention, regardless types intervention string one may use. Intervention string may in general be called an intervention cable. Over-pull may lead to break of the intervention cable/string due to too high tension, and one may risk to fish in the well for both string and intervention tool. Over-push may only be conducted on a rigid, rod formed, intervention cable, and not on a wire that has no particularly bending stiffness.

In general one may have the following situations:

| Force F vs. movement V | The string runs upward (−) | The string runs downward (+) |
|---|---|---|
| Upward drag (−) | lifting out of the hole: F and v parallel upwards. Coiled tubing, carbon fibre rod cable wire line Over-pull possible Active exceeding of the limits possible. | Controlled lowering into the hole. F and v anti-parallel Coiled tubing carbon fibre rod cable wire line (rope) Over-pull possible Passive exceeding of the limit is possible. |
| Pushing/ rodding downward | Pushing downwards while the rod is coming out of the hole: F and v anti-parallel [fuzzy]Coiled tubing carbon fibre rod cable either short temporary breaking or uncontrolled blow out. (exotic situation), (over-push possible) | Rodding into the hole: F and v parallel downwards. Coiled tubing Carbon fibre rod. Over-push possible. Active exceeding of the limits possible. |

Among the four situations in the matrix above, the left and lower is not very relevant in this description; that one pull down while the rod is coming out of the hole. Lifting, controlled lowering and rodding down into the hole, are all relevant to this patent application.

Prior Art In The Field

Pressure relief valve: In prior art, it is used, at the tractor belt injector for the intervention cable, a hydraulic pump which supplies hydraulic oil, to a hydraulic motor, at the tractor belt injector. An operator controlled pressure relief valve (pilot operated relief valve), in the prior art, is limiting the maximum pressure from the pump. The pressure relief valve thus limiting the maximum torque at the motor to push a rod or a coiled tubing, or to pull the same, or a thin string. The pressure relief valve drops down the pressure in the main hydraulic line to the motor if the pressure exceeds a certain level. The operator adjust the valve according to the demanded force of the operation, independent to the other system described below. The limited pressure for the pump limiting, not only the traction force to the string, but also the available torque for accelerate.

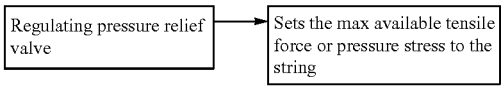

The Pump is Deactivated

The pump is deactivated if the tensile force exceed a set level. The weight sensors (generally two) is connected to a programmable logic controller (PLC). The logic control unit, PLC, acts on an over-pull or over-push in a two steps way:

1) Audible and visible alarm, no acting.
2) Deactivating of the pump via the pilot lines. PLC activates a solenoid-valve which drops down the pilot pressure from the pump, which effectively locks the drum or the injector in its place.

The operator sets the limits for each of the two steps independent, since that is considered necessary according to the operation.

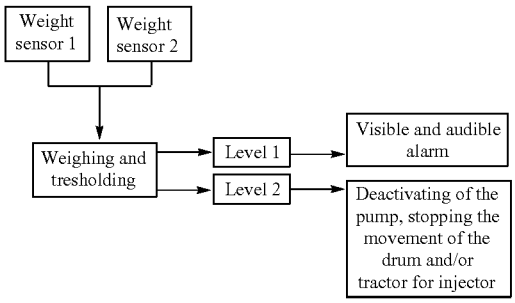

The weight sensors, between the tractor belt injectors and the well, neither do provide especially adequate values for the rodding force or pull force to the intervention string, due to the lack of a proper measure of the backward tension. In the situations of a freely hanging intervention string, between the goose neck and the top of the tractor belt injector, and where the intervention string extends to a drum, there is no exact measure of the backward tension. Without an exact measurement of the backward tension, one has no exact value for the real sum of forces acting downwards or upwards the intervention string, as it passes up or down between the lock chamber and the tractor belt injector, since the weight sensors may not be adjusted for the backward tension to the intervention string in this situation.

WO9814686A1 describes a tubing injection system that contains one injector for moving a tubing from a source thereof to a second injector moves the tubing from the tubing source to the second injector. In each of the tubing injection system sensors are provided to determine the radial force on the tubing exerted by the injectors, tubing speed, injector speed, and the back tension on the source. A control unit containing a computer continually maintains the tubing speed, tension and radial pressure on the tubing within predetermined limits. The control unit is programmed to automatically control the operation of the tubing injection systems according to programs or models provided to the control unit US 20110168401A1 discloses a subsea coiled tubing injector apparatus comprising:

a linear actuator; and a pair of carriages coupled via the linear actuator; wherein the linear actuator is electrically powered and is configured to apply lateral force to the carriages; wherein the carriages are configured to move substantially laterally with respect to one another; and wherein each carriage comprises a tubing engagement assembly configured to engage tubing interposed between the carriages. WO2011096820A1 describes A bend restrictor for an elongate flexible element, such as a cable, comprising at least two guide elements and a link element, each said guide element comprising spherical portions for coupling to respective spherical portions in said link element in a manner allowing angular movement between the respective guide elements and between the link element. The bend restrictor comprises first stop means on each guide element, for abutment against respective second stop means on the link element.

SHORT SUMMARY OF THE INVENTION

The present invention works out more of the above mentioned problems. The invention is a petroleum well injection system for an intervention cable (2) with a well tool (3), ran into, or out of, a well (0) during a well operation, wherein the system comprises the following features:

- a blow out valve BOP (03) connected to a well head (02) at a well (0),
- a lock chamber (7) at the BOP (03) arranged to contain the well tool (3) before and after the well operation,
- a tractor belt- or a tractor chain-injector (1) for the intervention cable (2), with drive belts (15) driven by an electric motor (11), and a sensor (151) for measuring the injector force or the tension ($\sigma_D$) that the drive belts(15) applies to the intervention cable (2),
- a guide arch (12) at the injector (1), wherein the intervention cable (2) runs taut over the guide arch (12) to a first end (21) of the closed bending restrictor channels (20).
- a guide arch load cell (45) arranged to measure the backward tension ($\sigma_B$) between an intervention cable (2) the first end (21) of the bending restrictor channel (20)
- wherein the other end (22) of the bending restrictor channel (20) is connected to a drum frame (92) with a motor (98) running a drum (91) for the intervention cable (2).

Further features of the invention are defined by the dependent patent claims

FIGURE CAPTIONS

The invention is illustrated in the attached drawings, wherein

FIG. 1 illustrates the petroleum well injection system for an intervention cable (2), holding a well tool (3,) that is run into, or out of a well (0), during a well operation. A well tractor is shown as well. The intervention cable (2) is shown by broken line. The well tool is shown hanging some distance down in the well. The well may be vertical or deviated drilled, and may extend 1000 m-10 km or more from the well head.

Figure 2:
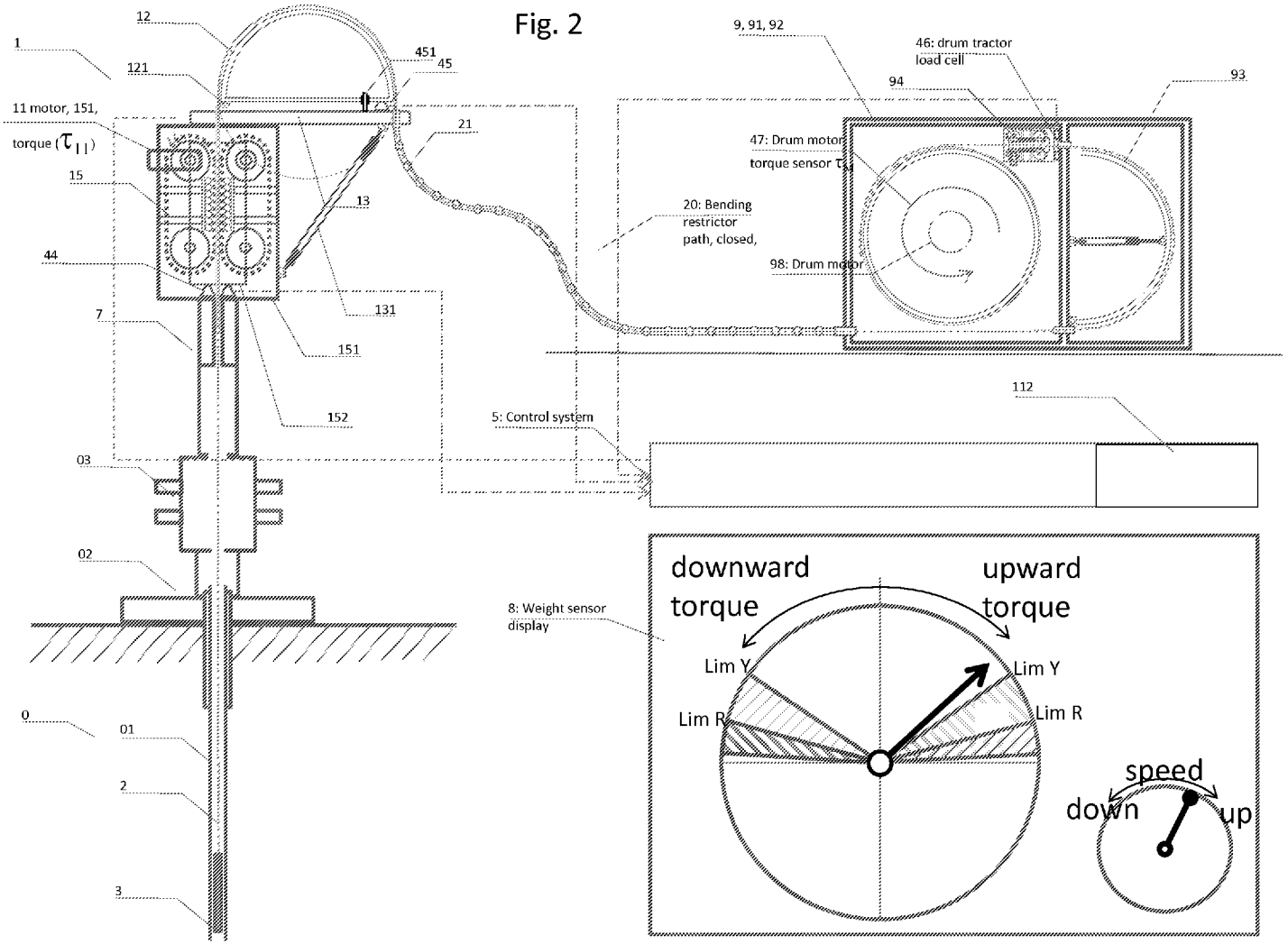

FIG. 2 illustrates the system without a well tractor, and with signal- and control-lines between the control system and the injector and the drum. Further, the figure shows an operator panel that shows torque or force to the intervention cable, inclusive "yellow" and "red" limits (Lim Y, Lim R) for torque or force to the internvention cable, and a speed indicator upward or downward.

FIG. 3 illustrates forces acting on the intervention cable from the injector and in the well. Dynamic forces as friction are not shown. In the illustrated situation, it is shown forces during hauling up from the well. The well pressure will always act upwards, and there has to be a backward tension.

Above lock chamber/grease injektor (7) applies:

Static: $F_I = F_D + F_{Bak}$ $F_D$ may be reduced form the motor (11) torque ($t_{11}$)

$F_{Bak}$ measured at the load cell (45).

Further applies:

Below injektor (without tractor): Static: $F=F_{cable}+F_{tool}-F_{pressure}$ $F_p=F_{pressure}$ depending of $Ø_{cable}$ $F_c=F_{cable}=m_{cable*g}$ $F_{traktor}=F_t=F_{tool}=m_{tool}*g$

Embodiments of the Invention

A solution to the problem of a free hanging intervention cable is to place such an intervention cable in the form of a relatively rigid in a so called bending restrictor loop comprising pipe sections mutually connected end by end with a ball joint, see FIG. 1, arranged in a way that the bending restrictor loop exactly follows a closed channel between the drum and the injector, and has a local bending radius larger or similar to the minimal allowable bending radius. This prevents impacts, break and friction damages to the composite intervention cable, and it prevents damage of the surroundings.

However, a closed loop between the injector and the drum gives a more limited slack in the intervention cable. Thus, according to an embodiment of the invention, it is necessary to primarily control the injector, and let the drum operate as a slave thereof, since the rotational torque of inertia of the drum is larger than of the injector. In an advantageous embodiment of the invention it is also arranged a springy tension compensator arc for the intervention cable, between the drum frame and the drum, to handle the cable length during speed changes. This demands good control of the forces acting on the intervention cable. The present invention supplies such measurements of backward tension from the cable in the injector, and the torque applied to the cable in the injector, knowing not only the injectors force, but the force by the total system downwards or upwards the intervention cable as it passes the injector and the upper opening of the lock chamber.

By calculating the force, or the tension, or the compression stress, the system applies to the cable above the lock chamber, by measuring both backward tension in a new way according to the invention, and where one gets a better measurement of the injector torque, one gain a better measurement of this force or tension or compression stress. The use of electric motor also gives the possibility to a faster respond to change in force than use of a hydraulic motor. According to an embodiment of the invention the tensile stress in the cable is monitored continuously, and if raising above a first "yellow" limit, the torque at the motor is reduced immediately, so that the tensile stress is reduced to below the first limit. If the tensile stress raises to above the second "red" limit the system immediately will reduce the motor torque to zero so the tensile stress again ends up below the second "red" limit and further reducing to below the first "yellow" limit. This applies both to hauling and rodding.

The invention is a petroleum well injector system for an intervention cable (2) for a well tool (3) that is run into, or out of, a well (0) during a well operation. The system according to the invention comprises the following features, se FIG. 1. A controlled well tractor (35) may be arranged by the well tool (3), see FIG. 1, running the lower part of the intervention cable (2) and the well tool (3) in the desired direction, and co-operate with the injector (1) at the surface.

A blow out valve, BOP, (03) is connected directly or indirectly to a well head (02) at the well (0). The blow out valve may be a regular blow out valve or a so called intervention blow out valve. A lock chamber (7) is mounted directly or indirectly at the BOP (03), and arranged to contain the well tool (3) before/after a well operation. A connector is mounted at the well end of the cable, which is extending down into the lock chamber wherein a well tool is located before and after a well operation.

A belt- or a chain-injector (1) for the intervention cable (2) is mounted above the lock chamber (7). The injector (1) is a well injector arranged with drive belts (15) for the intervention cable (2). The drive belts, that may comprise chains with gripper blocks that bear against the intervention cable (2) and runs this, is ran by one or more electrical motors (11), with controlled torque ($\tau_D$), to exerting a force (FD)(FDu, FDd) upward or downward to the string (2). The drive belts are preferably driven by a frequency controlled electric motor (11). One of the essential point by the invention is to use an electric motor (11). That the motor (11) is a preferably frequency controlled electric motor makes it well qualified arranged to very fast exerting the desired torque ($\tau_D$) for a force (FDu, FDd) to the string (2) in the desired direction. From here, F is positive upwards directed. That the motor is electric is a practical feature that is a part of what distinguish between the invention and existing systems hydraulic motors that is arranged with hydraulic valves and where the work has a longer admission response time. The response time, in hydraulic engine-driven well head injectors, may be in the range of 1 sec, which is much slower than the well head injector system of the present invention, which in an embodiment is arranged with a frequency controlled electric motor (11), which has a response time like or above 0.065 ms. One may measure the torque applied from the motor to the drive belts (15) at any time.

The injectors (1) drive belts (15) is floating supported in an injector belt frame (152) on injector load cells (44) that measure the weight of the drive belts (15), and appurtenant equipment, and may be tared without the intervention cable (2). The injector belt frame (152) is floating supported in a structural frame (151) for the injector (1), so that the injector belt frame (152) rests on the load cells (44), but standing generally stable in the structural frame (151), and is prevented from lateral movement.

Comments on Forces Acting on the Intervention Cable

A sensor (151) measures the injector force or the tension (σD) acting on the intervention cable (2) by the drive belts (15). Tension or compression stress (D) [a or compression force (FD)] that the drive belts (15) exerting to the intervention cable (2), may be measured by the torque ($\tau_{11}$) applied by the electric motor. One may recalculate between torque ($\tau_{11}$) and force (FD) and tension ($\sigma_D$), when the working radius of the drive belts(15) and the cross section area (A2) of the cable, are known.

The tension ($\sigma_D$) exerted by the drive belts (15) to the intervention cable (2) is not tension or feeding stress (FI) that the intervention cable (2) pulls out of or rodding down to the lock chamber (7) and the BPO (3,) since there is a backward tension ($\sigma_B$). The intervention cable (2) is exposed to a forward directed tension or a pressure stress ($\sigma_D$) towards the well side, the lock chamber (7) and the BOP (3), and a backward tension ($\sigma_B$) (not the back pressure stress during operation, that is undesired) upwards directed and passing the guide arch (12) and further downwards. We assume positive force as being upwards directed. The tension ($\sigma_I$) into the lock chamber (7) will then become $\sigma_I=\sigma_D+\sigma_B$. If all upwards directed forces are set as positive i.e. away from the well, which is practical, the formula for the tension then becomes: $\sigma_I=\sigma_D+\sigma_B$.

Expressed by word, the tension upwards ($\sigma_I$) out of the lock chamber (7) is tension ($\sigma_D$) applied by the drive belts adding backward tension ($\sigma_B$).

The location of the backward tension sensor (45) in the system allows a relatively exact, and realistic, measure of the backward tension ($\sigma_B$), and with that obtaining a much better control of the feeding tension ($\sigma_B$) (or the feeding force (FI) to the intervention cable (2) into the top of the lock chamber (7) and the BOP (3). By help of the system one know the backward tension ($\sigma_B$) and the tension or the pressure stress ($\sigma_I$) that the drive belts exerts to the intervention cable (2). One knows the weight of the guide arch and may tare for this, and one may not, strictly speaking, know the weight of the drive belts (15) and the appurtenant equipment that bear against the injector load cells (44), but this weight might be used as a control to find out whether the drive belts (15) slips against the intervention cable (2).

The tension ($\sigma_D$, ) or the force (FDu, FDd,) acted by the drive belts (15) to the intervention cable (2) is not tension or feeding stress (FI) that the intervention cable (2) pulls out of or rodding down to the lock chamber (7) and the BOP (3) since there is a backward tension ($\sigma_B$) also acting in the direction upward the intervention cable. This backward tension is, according to the invention, measured. The intervention cable (2) is exposed to a forward directed tension, or a pressure stress ($\sigma_{FI}$) towards the well side against the lock chamber (7) and the BOP (3) and a backward tension ($\sigma_B$) (not the back pressure stress during operation, that is undesired) upwards directed and passing the guide arch (12). Then one may not, strictly speaking, need the load cell (44) under the injector belts (15), which then may be used as a control for possible control if the injector belts (15) slip against the intervention cable (2).

Goose Neck/Guide Arc

Further there is arranged a guide arch (12) at the injector (1), wherein the intervention cable (2) runs taut over the guide arch (12) to a first end (21) of the closed bending restrictor channels (20). The closed bending restrictor channel (20) is hinged close to the outer end of a control arm (13) that supports an outer end of the guide arch (12). The opposite end of the guide arch (12) is supported in a horizontal axis (12) and may be pivoted around this point. The bending restrictor channel may considered to be a sort of over dimensioned wire casing around the intervention cable (2) between the first end (21) against the control arm (13) under the guide arch (12) and with a bending restrictor channels opposite end (22) against the drum frame (92). This opposed to having the intervention cable hanging free between the drum and a random tangential point at the guide arch, where one may measure the tension at the drum side. The backward tension ($\sigma_B$), ore more correct, the tensile force (FB) at the intervention cable (2) corresponds to the pressure stress, or more correct, the compressive force (F20) in the bending restrictor channel (20). Recalculating between the force and the tension are simply adjusting with regard to the cross section area.

Guide Arch Load Cell

To measure the backward tension ($\sigma_B$) it is, according to the invention, mounted a guide arch load cell (45) arranged to measure the force between the tared guide arch (12) and the control arm (13) for the guide arch (12) and with that the guide arch load cells (45) measures the force corresponding to the backward tension ($\sigma_B$) the intervention cable (2) applies between the control arm (13) and the first end (21) of the bending restrictor channel (20). Together with the load cell (45) it may be mounted a vertical guide pin (451) preventing a lateral displacement between the control arm (13) and the free end of the guide arch (12). A strut (131) supports the control arm (13).

Even if it, due to the friction between the intervention cable (2) and the guide arch (12), is a certain different between the exact backward tension ($\sigma_B$) in the intervention cable where it passes up between the top of the drive belts (15) and the first, close to the well end (12$_I$) of the guide arch (12), and the backward tension ($\sigma_B$) measure at the opposite end (12$_{BB}$) of the guide arc (12), i.e, at the control arm (13). Guide arch (12) may comprise sheaves (12T) and thus have a rather low friction against the intervention cable (2). The error of the measurement of the backward tension will thus be very small, and one may use the value of the backward tension ($\sigma_B$).

FIG. 3 illustrates the static forces in the area around the well head and the injector. The forces are illustrated during hauling. The friction is not drawn up, but will in any static case work against the speed direction. Above the lock chamber (7) with the grease injector, the system exerts a force FI upward or downward the intervention string. If we look at the system as static, the $F_I=F_D+F_{Bak}$. The force ($F_D$, $F_{Du}$, $F_{Dd}$) applied upward or downward the intervention cable by the injector, may be calculated by the motor (11) troque ($\sigma_{11}$), and the force $F_{Bak}$, applied to the intervention cable by the drum unit, may be measured by the load cell (45). Below the injector the force $F=F_{cable}+F_{tool}-F_{pressure}$, wherein $F_{pressure}$ is the force upwards the invention cable directing out of the well, and is dependent on the diameter of the cable and the well pressure. $F_{cable}+F_{tool}$ is depending on the cable mass per length unit, and the mass and volume of the tool. Dynamic correction term has to be added for the friction all the way along the cable, and a possible term for the force from the well tractor (35) by the tool (3).

By this, the main characteristic of the invention are drawn up. One may, by means of a sensor (151) measure or calculate the injector force or the tension ($F_D$, $\sigma_D$) to the intervention cable (2) by the drive belts (15), and one may measure the backward tension or the tension ($\sigma$) resting on the intervention cable (2), form the drum side. Then, one may adhere (or subtract, depending of definition of directions) and find out which force working along the intervention cable (2) from the system above the lock chamber unit (7).

Possible Simplification

In a hypothetical, simplified embodiment of the invention, the guide arch (12) is redundant, if the bending restrictor channel (20) is self-supported and mounted just on top of the well head injector, in a way that the bending restrictor channel (20) constitutes a guide arch as well. The load cell (45) may then be arranged between the well head injector frame and the first end of the bending restrictor channel (20). The bending restrictor channel (20) may be compared to a direct arranged outer casing (wire).

Tension Compensator Arch

In an embodiment of the invention, see FIG. 1, the drum unit (9) comprising the drum (91), and the drum frame (92), arranged with a preferably resilient tension compensator arch (93) for the intervention cable (2), between the drum frame (92) and the drum (91). This fo the tension compensator arch (93) to hold the intervention cable (2) in a continuous stretch between the injector (1) and the drum (91). Such a rigid intervention cable may not be allowed to run without a tensioned system when it shall be further coiled up at the drum (91). The tension compensator arch (93) may be active or passive resilient (by the means of a spring or controlled hydraulic). The tension compensator arch is arranged to absorb quick variations in the intervention cable (2) speed, in or out of the drum, that has a rotational moment of inertia which enables it to absorb the speed changes of the intervention cable (2) fast enough. A reason for the speed of the injector is that it may, in the present invention, be driven by an electric motor (11). Moreover the tension compensator arch has to hold the backward tension in the intervention cable (2) all the way from the injector (1), and particularly over the guide arch (12), which do not allow slack if the intervention cable (2) lies freely, further through the bending restrictor channel (20,) and via the drum unit frame (92), to the tension compensator arch (93) itself, which neither takes slack. The system has to be regulated strictly, so that it mainly controls the injector (1) to feed the intervention cable down, to stand still, or hauling it up of the well, and wherein the drum motor (98) and possible a drum auxiliary tractor (94) are slaves of the injector itself.

Drum Auxiliary Tractor

The petroleum well injection system according to claim 2 wherein the drum frame (92) is arranged with a drum auxiliary tractor (94) for the intervention cable (2), arranged between the resilient tension compensator arch (93) and the drum (91).

Regulating the Injector Force

According to one embodiment of the invention, one or more motors (11) is a frequency controlled electric motors arranged for quick response for a desired torque (τD), for a force (Fu, Fd), form the injector belts (15) to the string (2), in a desired direction.

In an embodiment of the invention the control unit (5) is arranged in a way that at the first "yellow" limit ($\sigma_Y$) for the tensile stress (σ), the unit (5) immediately reduce the desired torque (τD) so the tensile stress ($\sigma_I$) ends below a given limit.

In a preferred embodiment, preferably the torque (τD) is reduced and by that the tensile stress will ends below the first "yellow" limit ($\sigma_Y$).

According to an embodiment of the invention the control unit (5) at the first "yellow" limit ($\sigma_Y$) for the tensile stress ((σ)) is arranged to give a first alarm signal (6Y) at the same time as the immediate reduction of the desired torque (τD) for the tensile stress ($\sigma_I$) to get below a given limit for the tensile stress ($\sigma_I$) to the intervention cable (2).

According to an embodiment of the invention the control unit (5) feeds out calculated values of at least tensile stress ($\sigma_I$) in the string (2) to a so called "torque indicator" at a so called "weight sensor display" (8), comprising indicators corresponding to a first "yellow" limit ($\sigma_Y$), and a second "red" limit ($\sigma_R$) for the tension ($\sigma_I$), both during feeding and hauling, for being displayed for an operator.

According to an embodiment of the invention the control unit (5) at the second "red" limit (R) for tension ($\sigma_I$) is arranged to give an alarm signal (6R), and at the same time immediately reduce the desired torque (τD) to zero, or to where the torque or the tension are ignorable small. In this way the torque (τD) is reduced to zero, and thus the tensile stress ($\sigma_I$) ends below the second "red" limit ($\sigma_P$) for the tensile stress ($\sigma_I$) and successively below the first "yellow" limit ($\sigma_P$). An advantage of this system is that at a sudden resistance during hauling or rodding of the intervention cable, for example in a situation along its path suddenly stops into an edge, or the tension in the cable suddenly increase, the torque at the injector will be reduced very fast, and thus contributes to that the intervention string or the tool is damaged. If the operator do not immediately see the alarm of the increased resistance, the system will prevent damage by reducing the injector force immediately.

According to an embodiment of the invention the control unit (5), is arranged so that after the speed (v) of the string (2) has reached zero, immediately increases the torque control signal to a desired torque value (τD ) that holds the string (2) still.

According to an embodiment of the invention the control unit (5) is arranged to calculate negative values for tension ($\sigma_I$) as well, which means the compression stress ($\sigma_{ID}$) along the string (2) which may occur during rodding, so both tension and compression ($\sigma_{IU}$, $Q_{ID}$) along the string (2) may be measured.

According to an embodiment of the invention the torque (τD) may be regulated so that a thrust force (FC) is added to the string downwards, till a maximum thrust force (FDmax).

According to a further embodiment of the invention, it is a petroleum well injection system for an intervention cable (2) with a well tool (3), run into or out of a well (0) during a well operation, wherein the system comprise the following features:

- a blow out valve BOP (03) connected to a well head (02) at a well (0),
- a lock chamber (7) at the BOP (03) arranged to contain the well tool (3) before and after the well operation,
- an injector (1) for the intervention cable (2), with drive belts (15) driven by an electric motor (11) to exerting a force (Fu, Fd) upwards or downwards the string (2), and a sensor (151) for measuring the injector force or the tension that the drive belts (15) applies to the intervention cable (2),
- a guide arch (12) at the injector (1), wherein the intervention cable (2) runs taut over the guide arch (12) to a first end (21) of the closed bending restrictor channels (20).
- wherein the other end (22) of the bending restrictor channel (20) is connected to a drum frame (92) with a motor (98) running a drum (91) for the intervention cable (2).

In an embodiment of the invention a guide arch load cell (45) is arranged to measure the back load tensile stress between an intervention cable (2) and the first end (21) of the bending restrictor channel (20).

In a further embodiment of the invention there is a control unit (5) for the electric motor (11), calculating tensile stress to the intervention cable (2) based on the back strain and the injector -force or- strain, and regulating feeding or hauling of the intervention cable (2).

In FIG. 2 it is illustrated that the control system (5) receives manual commands for speed of force upwards or downwards from an automatic or manual control (112), and receives values for the load cell (45) and the torque, or the force values form the electric motors (11). The control system (5) calculates the force (FI) that applies to the intervention cable (2), and sends signal for desired direction and force from the injection to the intervention cable (2). The control unit (5) may then control the drum motor (98) and possibly the drum auxiliary tractor (94) as slaves in the system, depending of the speed and direction of the injector.

The torque of the motors are approximately direct proportional to the force transferred to the intervention string and with that the tension or the compression in in the intervention string. The motor torque may thus be used in the calculations of the tension or compression in the intervention cable. It is also possible, in a reliable way, to limit the maximum torque that the motors may use in a variable frequency driving unit for the electric motors.

The following form may be used in an injector comprising two motors:

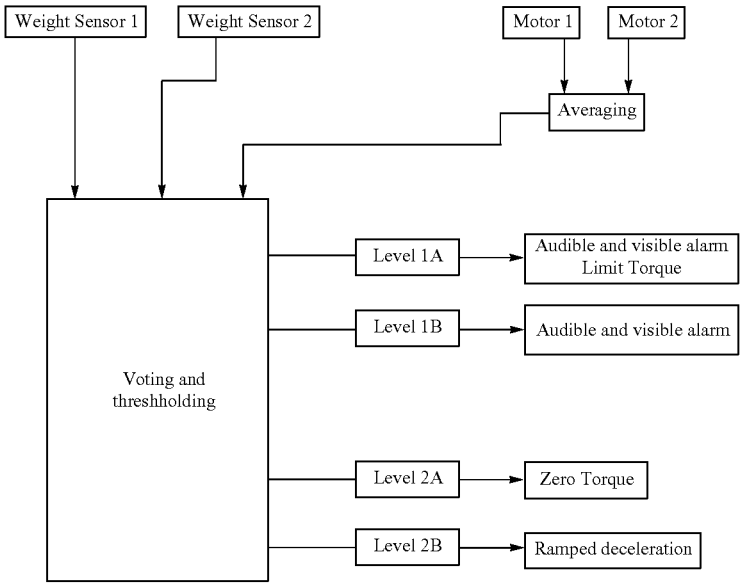

| State | Act |
|---|---|
| Normal operation | Full torque available for maximum dynamic response |
| Level 1A Active pass of the limits | * Audible and visible signal<br>* Limit the torque from the electric motors to a value below Level 1 |
| Level 2A | 1) Interim and immediate deactivating of the electric motors<br>2) Intertial forces that actively cross the limits will stop the movement of the intervention string<br>3) the motors activates when the speed becomes zero, and holds the intervention string in its position. |
| Level 1B passive crossing of the limits | * Audible and visible signal |
| Level 2B | 1) Lower the speed<br>2) The motors holding the string in its position |
| | |

The operator sets the limits for maximum pull and maximum push to the intervention string, according to level 2 in the form. Level 1 is calculated as a desired percentage of level 2 values. The values may be different for maximum pull and maximum pull.

The invention claimed is:

1. A petroleum well injection system for an intervention cable with a well tool run into or out of a well during a well operation, the petroleum well injection system comprising:

a blow out valve BOP connected to a well head at said well;

a lock chamber at the BOP arranged to contain the well tool before and after the well operation an injector for the intervention cable, with drive belts driven by an electric motor with controlled torque to exert a force upwards or downwards on the string, and a sensor for measuring the injector force or the tension that the drive belts apply to the intervention cable;

a guide arch at the injector, wherein the intervention cable runs taut over the guide arch to a first end of a closed bending restrictor channel;

a guide arch load cell arranged to measure the backward tension between an intervention cable and the first end of the bending restrictor channel; and a control unit for the electric motor calculating tensile stress in the intervention cable based on the backward tension and the injector -force or- tension and regulating feeding or hauling of the intervention cable, wherein the drive belts are supported floating at injector load cells, wherein the other end of the bending restrictor channel is connected to a drum frame with a motor running a drum for the intervention cable, and wherein the drum frame is arranged with a resilient tension compensator arch for the intervention cable between the drum frame and the drum.

2. The petroleum well injection system according to claim 1, wherein the drum frame is arranged with a drum auxiliary tractor for the intervention cable arranged between the resilient tension compensator arch and the drum.

3. The petroleum well injection system according to claim 1, wherein the injector drive belts are supported floating in an injector belt frame and may be weight compensated for without the intervention cable, and wherein the injector belt frame is supported floating in a structural frame for the injector so that the injector belt frame rests on the load cells, but is generally stable standing in the structural frame and is prevented from lateral movement.

4. The petroleum well injection system according to claim 1, with automatic or manual control, or admission form a superior system asking for a given speed, giving a signal to a control unit, also receiving the value exerted by the injector force or tension exerted by the drive belts to the intervention cable, as well as the backward tension and calculated the tension to the intervention cable and calculated desired torque for the drive belts from the desired speed and direction of the intervention cable, and feeding out a desired torque for the force in the desired direction, to the motor, to gain a desired level for the tension.

5. The petroleum well injection system according to claim 1, wherein said motor is a frequency controlled electric motor arranged for quick response for a desired torque for a force form the injector belts to the string in a desired direction.

6. The petroleum well injection system according to claim 5, wherein the control unit at a first "yellow" limit for the tensile stress is arranged for immediate reducing the desired torque for the tensile stress to get under a given limit for the tensile stress to the intervention cable.

7. The petroleum well injection system according to claim 6, wherein the control unit at the first "yellow" limit for the tension is arranged to give a first alarm signal at the same time as the immediate reduction of the desired torque for the tension to get under a given limit for the tension at the intervention cable.

8. The petroleum well injection system according to claim 4, wherein the control unit feeds out calculated values of at least tensile stress to the string to a so called "torque indicator" at a so called "weight sensor display" comprising indicators corresponding to a first "yellow" limit and a second "red" limit for the tensile stress both during feeding and hauling, for being displayed for an operator.

9. The petroleum well injection system according to claim 4, wherein the control unit at a second "red" limit for tension is arranged to give an alarm signal and at the same time immediately reduce the desired torque to zero.

10. The petroleum well injection control system according to claim 9, wherein the control unit, after the speed of the string has reached zero, immediately increases a torque control signal to a torque value that holds the string still.

11. The petroleum well injection system according to claim 1, wherein the control unit is arranged to calculate negative values for tension as well, which means the compression stress along the string which may occur during rodding, so both tension and compression along the string may be measured.

12. The petroleum well injection system according to claim 1, wherein the torque may be regulated so that a thrust force is added to the string downwards, till a maximum thrust force.

13. The petroleum well injection system according to claim 1, further comprising a controlled well tractor at the well tool, running the lower part of the intervention cable and the well tool in the desired direction, said controlled well tractor co-operating with the injector, both the injector and the controlled well tractor being controlled by the control unit.

* * * * *